US007846544B2

(12) United States Patent
Nagamune

(10) Patent No.: US 7,846,544 B2
(45) Date of Patent: Dec. 7, 2010

(54) (DOPE-DYED) POLYESTER CORE-SHEATH MONOFILAMENT HAVING SPECIFIC CORE/SHEATH INTRINSIC VISCOSITY

(75) Inventor: Satoshi Nagamune, Chiyoda-ku (JP)

(73) Assignee: Teijin Fibers Limited, Osaka (JP)

( * ) Notice: Subject to any disclaimer, the term of this patent is extended or adjusted under 35 U.S.C. 154(b) by 715 days.

(21) Appl. No.: 11/793,251

(22) PCT Filed: Jul. 5, 2006

(86) PCT No.: PCT/JP2006/313369

§ 371 (c)(1),
(2), (4) Date: Jun. 15, 2007

(87) PCT Pub. No.: WO2007/013270

PCT Pub. Date: Feb. 1, 2007

(65) Prior Publication Data

US 2009/0324948 A1 Dec. 31, 2009

(30) Foreign Application Priority Data

Jul. 28, 2005 (JP) ..... 2005-218709
Aug. 31, 2005 (JP) ..... 2005-250910
Aug. 31, 2005 (JP) ..... 2005-250911

(51) Int. Cl.
*B32B 27/36* (2006.01)
*B32B 27/02* (2006.01)

(52) U.S. Cl. ..... 428/373; 428/374; 428/375; 428/378; 428/395; 264/103; 264/172.15; 264/172.17; 264/173.12

(58) Field of Classification Search ..... 428/403, 428/407, 373, 374, 375, 378, 395; 264/103, 264/171.11, 171.12, 171.15, 172.17, 173.12
See application file for complete search history.

(56) References Cited

U.S. PATENT DOCUMENTS 3,051,212 A * 8/1962 Daniels ..... 152/451
3,869,427 A * 3/1975 Meschke et al. ..... 525/437
4,024,895 A * 5/1977 Barron ..... 139/426 R
4,684,686 A * 8/1987 Hepp ..... 524/281

(Continued)

FOREIGN PATENT DOCUMENTS

EP 0 201 114 A1 12/1986
EP 201114 A1 12/1986
JP 02-289120 * 11/1990
JP 9-268419 A 10/1997
JP 11-100720 A 4/1999
JP 2001-226817 A 8/2001

(Continued)

*Primary Examiner*—H. (Holly) T Le
(74) *Attorney, Agent, or Firm*—Sughrue Mion, PLLC

(57) ABSTRACT

[PROBLEMS] To provide a polyester monofilament which shows a high dimensional stability and excellent effects of preventing peel-off in filaments, preventing pirn barre and preventing halation and has a high fineness, a high strength and a high modulus. [MEANS FOR SOLVING PROBLEMS] A core-shell type composite polyester monofilament comprising polyethylene terephthalate at a ratio of 80% by mol or higher, which satisfies the following requirements A to F: A) the intrinsic viscosity of the core component being 0.70 or above and the intrinsic viscosity of the shell component being from 0.55 to 0.60; B) the core component amounting to 50 to 70%; C) at least the shell component containing from 0.2 to 0.4% by weight of metal microparticles; D) the fineness of the monofilament being from 5 to 15 dtex, its modulus at elongation of 5% being from 3 to 4.5 cN/dtex and its elongation at break being from 20 to 40%; E) the free shrinkage of the innermost part under specific conditions being 0.3% or less; and F) the node density is one per 100,000 m or less.

12 Claims, 2 Drawing Sheets

U.S. PATENT DOCUMENTS 5,059,104 A * 10/1991 Alberto ..... 425/72.2
5,092,381 A * 3/1992 Feijen et al. ..... 152/451
5,354,529 A * 10/1994 Berger et al. ..... 264/176.1
5,378,537 A * 1/1995 Masuda et al. ..... 428/364
5,635,298 A * 6/1997 Delker ..... 428/373
5,652,057 A * 7/1997 Delker ..... 428/373
5,686,552 A * 11/1997 Masuda et al. ..... 528/193
6,340,525 B1 * 1/2002 Akamatsu et al. ..... 428/364
6,420,026 B1 * 7/2002 Okamoto et al. ..... 428/370
6,589,392 B1 7/2003 Skinner et al.
7,163,743 B2 * 1/2007 Atwood et al. ..... 428/375

FOREIGN PATENT DOCUMENTS

JP 2003-213527 A 7/2003
JP 2003-213528 A 7/2003
JP 2004-211221 * 7/2004
JP 2004-232182 A 8/2004
WO 01/00911 A1 1/2001
WO WO 01/00911 A1 1/2001

* cited by examiner

[Fig. 1]
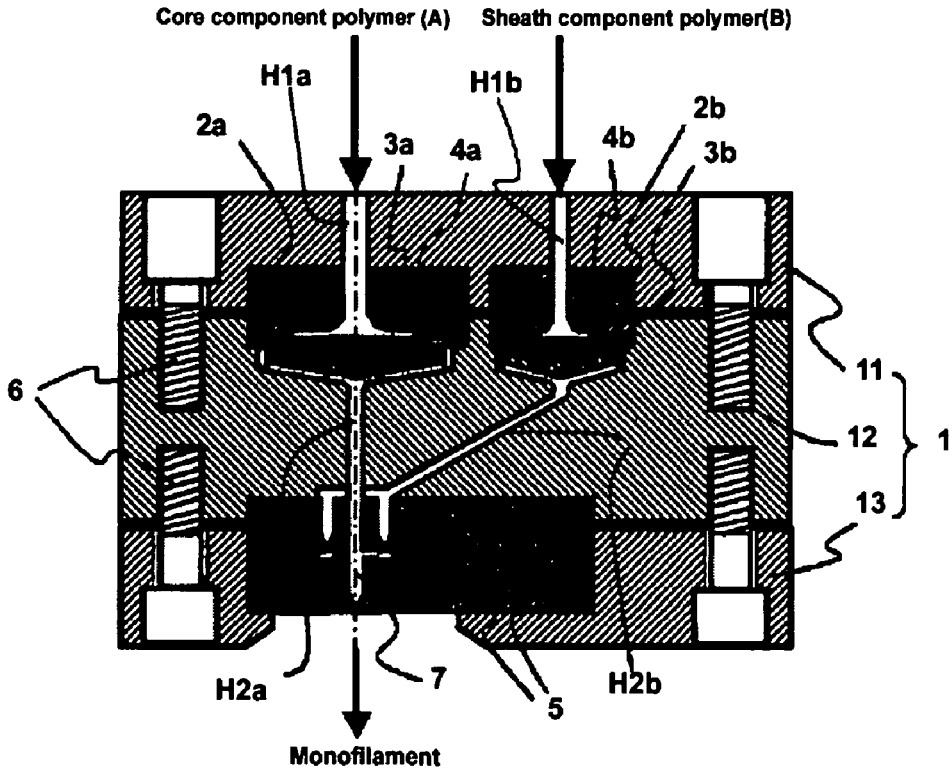
[Fig. 2]
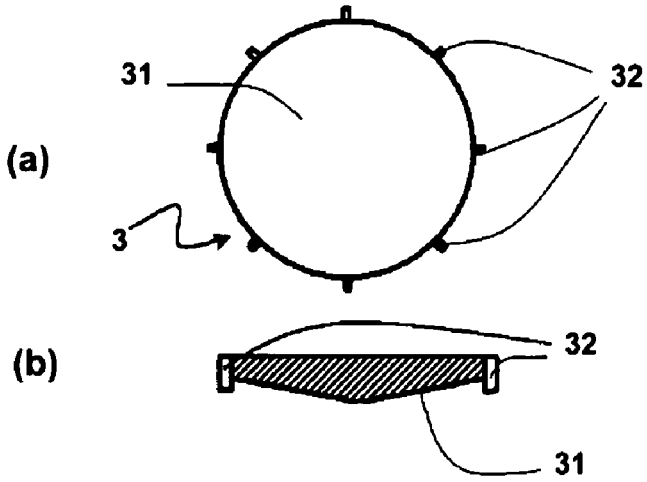

[Fig. 3]
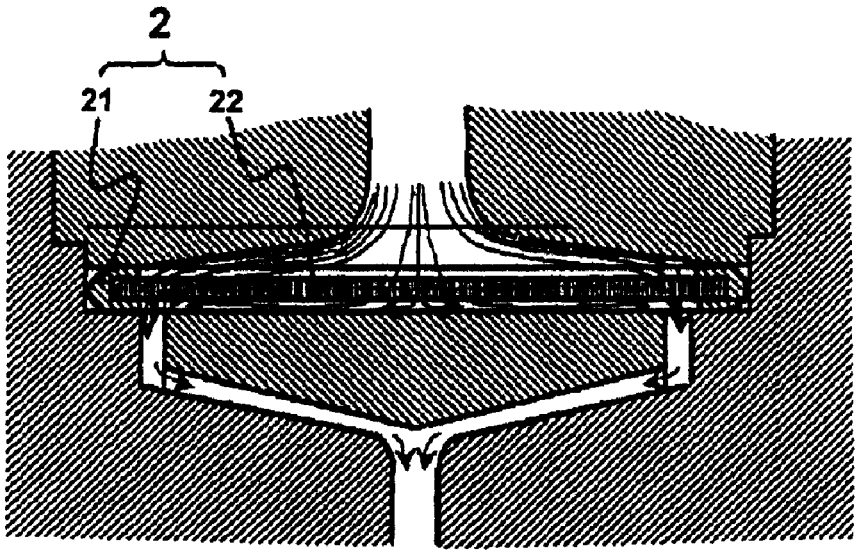
[Fig. 4] Conventional
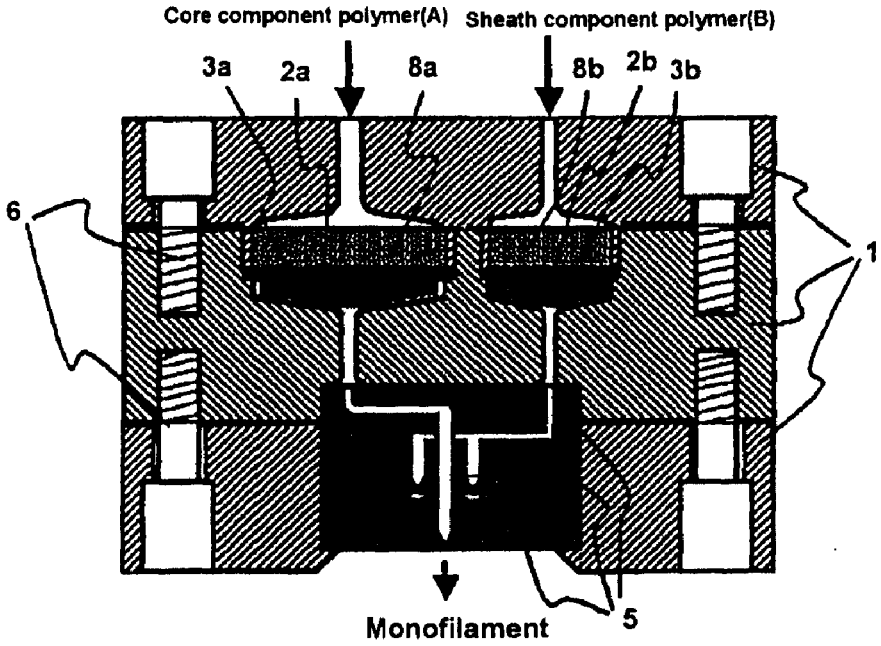

(DOPE-DYED) POLYESTER CORE-SHEATH MONOFILAMENT HAVING SPECIFIC CORE/SHEATH INTRINSIC VISCOSITY

TECHNICAL FIELD

The present invention relates to a (dope-dyed) polyester monofilament that is surface-modified and dope-dyed as needed. More particularly, the present invention relates to a (dope-dyed) polyester monofilament useful as a raw filament for ropes, nets, guts, tarpaulin, tents, screens, paragliders, sailcloth and the like, particularly suitable for obtaining mesh fabrics for screen printing, especially high-mesh high-modulus screen gauzes requiring high accuracy in the production of printed wiring boards and the like.

BACKGROUND ART

The polyester monofilaments have been widely utilized in not only the apparel field, but also the industrial material field. In particular, in the latter industrial material field, they are used as raw monofilaments, for example, for tire cords, ropes, nets, guts, tarpaulin, tents, screens, paragliders, sailcloth and the like. Physical properties required for these monofilaments have also become severe, and it has been urged to improve adhesiveness to rubber, fatigue resistance, dyeabiity, wear resistance, slub strength and the like.

In particular, the polyester monofilaments have recently taken the place of natural fibers such as silk and inorganic fibers such as stainless steel in the field of raw yarn for printing screen gauzes, because of their excellent dimensional stability.

However, in the recent printing field of electronic equipment such as printed wiring boards, the degree of integration increases more and more, and requirements for improvement in printing precision of screen gauzes, that is to say, requirements for high strength, high modulus and high mesh, have become severer therewith.

Accordingly, for the raw monofilaments, high-strength, high-modulus and finer ones have also been required.

In general, in order to increase the strength and modulus of the polyester monofilaments, what is necessary is just to perform hot drawing of spun filaments under a high draw ratio to highly orient and crystallize them.

However, in the subsequent process of screen gauze production, in order to comply with the requirement for the above-mentioned "high-mesh", high-density fabric is woven, which causes raw filaments to receive severer repeating friction particularly with reeds. Accordingly, whisker-like or powdery scraping of filament surfaces frequently occurs to impair not only productivity but also the quality level of products.

Moreover, the more highly oriented and crystallized the raw filaments are, and further, the finer the filament diameter of the raw filaments is, the stronger the above-mentioned tendency becomes. As a result, the accumulation of the scraping of the filaments induces a standstill of a weaving machine, and further, the scraping of the filaments woven into the screen gauzes brings about print defects in precision printing.

As a measure for inhibiting this filament scraping in weaving, for example, it is proposed in patent document 1 (JP-A-55-16948) to use high-elongation raw filaments having a breaking elongation of 30 to 60% as warps. However, the modulus of the high-elongation raw filaments become low, to put it the other way around, which conflicts with the requirement for the high-strength and high-modulus screen gauge.

In order to obtain high-strength and high-modulus raw filament, high-ratio drawing is necessary as described above. It is said that this causes the orientation of a surface layer portion of the filament to become higher than that of a center portion, resulting in that a phenomenon in which the surface is partially scraped by friction is liable to occur.

As a countermeasure for this, it is also variously proposed that a melt of a surface layer portion of a filament is changed, thereby making increased strength and modulus compatible with filament scraping inhibition in weaving. For example, patent document 2 (JP-A-1-132829) proposes that a polyester is arranged in a core portion and a nylon is arranged in a sheath portion to form a sheath-core structure, thereby improving ability of inhibiting filament scraping, although it has high strength. However, in this case, there arises a disadvantage that the dimensional stability of a raw filament is impaired caused by high moisture absorption inherent to the nylon. Further, a raw filament structure is the sheath-core structure composed of the polyester and the nylon that have no compatibility with each other, so that it has a fear that separation is liable to occur in an interface of both polymers when repeated fatigue is applied in printing.

In order to solve this separation problem, patent document 3 (JP-A-2-289120) proposes to employ a sheath-core structure in which a polyester homopolymer having an intrinsic viscosity of 0.80 is arranged in a core portion and a polyethylene glycol-copolymerized polyester having an intrinsic viscosity of 0.67 is arranged in a sheath portion. In a raw filament having such a sheath-core structure, brought into contact with reeds or healds and scraped by receiving friction is the polymer of a peripheral surface portion, so that this is characterized in that the copolymer having a low glass transition point, which is difficult to be scraped against friction and fatigue, is arranged in the surface portion. However, both polymers arranged in the core and the sheath are too much different from each other in their characteristics, so that when the structure is fixed by heat treatment, only conditions taking into account the deformation of the sheath component polymer can be used. Accordingly, the structure of the core component is insufficiently fixed, or the draw ratio for expressing strength is forced to be set higher. As a result, the effect of filament scraping inhibition decreases to fail to obtain a screen gauge having sufficient performance. Further, this raw filament employs the polymers different from each other in compatibility between them, so that a separation phenomenon occurs in an adhesion interface of the polymers.

Furthermore, patent document 4 (JP-A-2003-213520), patent document 5 (JP-A-2003-213527), patent document 6 (JP-A-2003-213528) and patent document 7 (JP-A-2004-232182) proposes to use polyester polymers that are not copolymers as sheath components.

Of these, patent document 4 (JP-A-2003-213520) is characterized in that drawing is performed while irradiating infrared light to obtain a high-modulus monofilament having a breaking strength of 7.5 cN/dtex or more and a breaking elongation of 5 to 15%. However, an irradiation spot of the infrared light is extremely small, so that deflection of a running filament from the spot due to swing of the filament is liable to occur. It is therefore difficult to apply such a technique to industrial production. Further, the monofilament having a breaking elongation of 5 to 15% is difficult to absorb impact applied to a fabric, so that filament breakage at the time of weaving and filament breakage caused by fabric fatigue at the time of repeated use are liable to occur. Furthermore, this is also liable to contribute to filament breakage in a drawing process.

In addition, patent document 5 (JP-A-2003-213527) and patent document 6 (JP-A-2003-213528) are characterized in that fine inorganic metal particles are allowed to be contained in a sheath component polymer, thereby decreasing the friction resistance of a filament surface. This is caused by allowing the fine inorganic metal particles to deposit on the filament surface by bleedout thereof to roughen the filament surface. However, in the course of transferring a melt thereof, aggregated particles deposit to excessively roughen the filament surface in some cases. This can become the factor of scratching a metal surface of a reed to further increase defects such as filament scraping with time. It is apparent that the presence of excessive fine inorganic metal particles decreases mechanical characteristics of the resulting monofilament, specifically the elongation. It is also the same in such a sheath-core composite filament that pirn contraction caused by fiber structure strain internally existing as a filament structure by an increase in modulus becomes liable to occur. Here, the term "pirn contraction" as used herein means a stripe-like unevenness which can be seen by the situation when filaments of the inner layer portion of pirn is used as a weft. The pirn contraction is caused by tightening of winding in the inside of the pirn layer.

Moreover, patent document 7 (JP-A-2004-232182) proposes to subject this to a 2-10% relax treatment after drawing, thereby removing the fiber structure strain. However, when the monofilament is relaxed to such a large extent, an extremely large decrease in modulus at an intermediate elongation is induced, resulting in insufficient filament characteristics. When the draw ratio is further increased in order to compensate this, not only pirn contraction occurs but also the effect of inhibiting filament scraping according to the sheath-core composite structure is lost. Further, also in a drawing process, swing of a running filament becomes large under such large-relax conditions, which causes a factor of deteriorating process yield.

Further, patent document 8 (JP-A-2001-11730) proposes a method for obtaining a pseudo sheath-core type monofilament utilizing the difference in intrinsic viscosity, which is expressed by the difference in flow rate of a melt in the inside of a spinning pack. However, this method has a risk that the sheath-core ratio and the difference in intrinsic viscosity vary depending on the flow of the melt in the inside of the pack, and therefore lacks stability. Changes in the flow of the melt possibly occur using as a trigger changes in inner pressure balance of the pack caused by, for example, a clogged state of a filtration tank. Accordingly, a fear remains in stability for fluctuations with time of spinning, variations among spindles at the time when the spindles are increased and repeating reproducibility for each production lot.

[Patent Document 1] JP-A-55-16948
[Patent Document 2] JP-A-1-132829
[Patent Document 3] JP-A-2-289120
[Patent Document 4] JP-A-2003-213520
[Patent Document 5] JP-A-2003-213527
[Patent Document 6] JP-A-2003-213528
[Patent Document 7] JP-A-2004-232182
[Patent Document 8] JP-A-2001-11730

DISCLOSURE OF THE INVENTION

Problems that the Invention is to Solve

An object of the present invention is to provide a (dope-dyed) polyester monofilament that has excellent dimensional stability, the effect of inhibiting filament scraping, the effect of preventing pirn contraction and the effect of preventing halation, which have not been obtained for the conventional monofilaments, has such fine fineness that the production of a high mesh is possible, high strength and high modulus, and is dope-dyed as needed.

Means for Solving the Problems

The present invention relates to a sheath-core type composite polyester monofilament in which 80 mol % or more of a structural unit is polyethylene terephthalate, wherein the following A to F are satisfied:

A. A polyester of a core component has an intrinsic viscosity of 0.70 dL/g or more, and a polyester of a sheath component has an intrinsic viscosity of 0.55 to 0.60 dL/g;

B. The weight ratio of the core component is from 50% to 70%;

C. Fine metal particles are contained in polyethylene terephthalate constituting at least a sheath component in an amount of 0.2 to 0.4% by weight;

D. When the monofilament has a fineness of 5 to 15 dtex, the modulus at an elongation of 5% is from 3 to 4.5 cN/dtex, and the breaking elongation is from 20 to 40%;

E. The degree of free shrinkage of the monofilament in a most inner layer portion of a taken-up package measured 10 days after winding up is 0.3% or less; and F. The number of slub portions per 100,000 meters in a filament longitudinal direction, which are 10 μm or more thicker than a filament diameter, is 1 or less.

Further, the present invention relates to a dope-dyed sheath-core type composite polyester monofilament in which 80 mol % or more of a structural unit is polyethylene terephthalate, wherein the following A to F are satisfied:

A. A polyester of a core component has an intrinsic viscosity of 0.70 dL/g or more, and a polyester of a sheath component has an intrinsic viscosity of 0.55 to 0.60 dL/g;

B. The weight ratio of the core component is from 50% to 70%;

C'. Fine metal particles are contained in polyethylene terephthalate constituting at least a sheath component in an amount of 0.2 to 0.4% by weight, an organicpigment is contained therein in an amount of 0.2 to 1.0% by weight, the b value of the monofilament is 60 or more, and the L value is from 70 to 80;

D. When the monofilament has a fineness of 5 to 15 dtex, the modulus at an elongation of 5% is from 3 to 4.5 cN/dtex, and the breaking elongation is from 20 to 40%;

E. The degree of free shrinkage of the monofilament in a most inner layer portion of a taken-up package measured 10 days after winding up is 0.3% or less; and F. The number of slub portions per 100,000 meters in a filament longitudinal direction, which are 10 μm or more thicker than a filament diameter, is 1 or less.

By the way, when the polyester monofilament that is not dope-dyed and the polyester monofilament that is dope-dyed are common to each other, they are hereinafter referred to as the "(dope-dyed) polyester monofilament" or the "polyester monofilament" in some cases, and when limited to the dope-dyed one, it is hereinafter referred to as the "dope-dyed polyester monofilament" in some cases.

Next, the present invention relates to a melt spinning method of the above-mentioned (dope-dyed) polyester monofilament, which is a sheath-core type composite polyester monofilament in which a core component polymer and a sheath component polymer comprise a polyester, wherein the retention time of the core component polymer from introduction into a spinning pack to extrusion from a spinneret is from 10 seconds to 3 minutes.

Then, the present invention relates to a spinning pack for the above-mentioned (dope-dyed) polyester monofilament that is a sheath-core type composite polyester monofilament in which a core component polymer and a sheath component polymer comprise a polyester, wherein flow paths of the core component polymer that are formed in the above-mentioned spinning pack are arranged so as to vertically form a straight line with the interposition of a polymer flow path formed in a filter medium unit, the above-mentioned polymer flow path formed in the filter medium unit for the core component polymer is circularly formed in a peripheral portion of the filter medium, and the retention time of the core component polymer in the spinning pack is from 10 seconds to 3 minutes.

Advantages of the Invention

The polyester monofilament of the present invention is a (dope-dyed) monofilament having excellent dimensional stability, the effect of inhibiting filament scraping, the effect of preventing pirn contraction and the effect of preventing halation, which have not been obtained for the conventional monofilaments, having such fine fineness that the production of a high mesh is possible, and suitable for a high-strength, high-modulus screen gauge.

BRIEF DESCRIPTION OF THE DRAWINGS

FIG. 1 is a schematic explanatory illustration (sectional front view) showing for illustrating one embodiment of a spinning pack of the present invention.

FIG. 2 is schematic explanatory illustrations specifically showing one embodiment of a polymer distributing member of the present invention, wherein FIG. 2(*a*) is a bottom plan view looked down from the bottom, and FIG. 2(*b*) is a sectional side view.

FIG. 3 is an image illustration for illustrating a specific image of polymer flows in a filter medium supported with the polymer distributing member of FIG. 2.

FIG. 4 is a schematic explanatory illustration (sectional front view) showing for illustrating one embodiment of a conventional spinning pack.

DESCRIPTION OF REFERENCE NUMERALS AND SIGNS

1: Pack Body

2*a:* Filter Medium for Core Component Polymer (Wire Mesh Filter)

2*b:* Filter Medium for Sheath Component Polymer (Wire Mesh Filter)

3*a:* Distributing Member for Core Component Polymer

3*b:* Distributing Member for Sheath Component Polymer

4*a:* Core Component Polymer Introduction Member

4*b:* Sheath Component Polymer Introduction Member

5: Spinneret for Multi-Component Spinning

6: Fastening Bolts

7: Spinning Orifice

11: Upper Pack Body

12: Intermediate Pack Body

13: Lower Pack Body

H1*a:* Core Component Polymer Introduction Flow Path

H1*b:* Sheath Component Polymer Introduction Flow Path

H2*a:* Core Component Polymer Flow Path

H2*b:* Sheath Component Polymer Flow Path

BEST MODE FOR CARRYING OUT THE INVENTION

The polyester monofilament of the present invention is a sheath-core type composite polyester monofilament in which 80 mol % or more of a structural unit is polyethylene terephthalate.

The polyester constituting the monofilament of the present invention comprises ethylene terephthalate units as main repeating units. The term "main" as used herein means 80 mol % or more, preferably 90 mol % or more, and particularly preferably 95 mol % or more, of all repeating units. A third component other than the terephthalic acid component and the ethylene glycol may be copolymerized at a ratio of 20 mol % or less. However, from the viewpoint of the high-strength, high-modulus monofilament, polyethylene terephthalate substantially having ethylene terephthalate units as repeating units is preferred as described later. The term "substantially" as used herein means that a copolymerizable component is not positively used when the polyester is produced. Foe example, a by-product such as diethylene glycol is produced in a production stage of the polyester, and this may be copolymerized in the polyester.

The polyester polymers used in the present invention are polymers in which 80 mol % or more of a structural unit is polyethylene terephthalate in both the core and sheath components, and which are substantially the same as with each other in characteristics other than intrinsic viscosity. This removes a fear of separation at an adhered face of the two components by compatibility therebetween.

Further, the polyester monofilament of the present invention is a sheath-core type composite monofilament in which the core component is arranged so as to be covered with the sheath component in its cross section and to be not exposed from a surface of the monofilament. The term "sheath-core type" as used herein means that what is necessary is just that the core component is completely covered with the sheath component, and they are not necessarily required to be concentrically arranged. As for the cross-sectional shape, there are several shapes such as circular, flat, triangular, square and pentangular shapes. However, the circular cross section is preferred in terms of stable filament production properties, easily obtainable higher-order processability, and stability of mesh openings for inhibiting the occurrence of halation when an emulsion is applied after weaving and exposed to light.

Then, in the polyester monofilament of the present invention, it is necessary that the polyester of the core component has an intrinsic viscosity (IV) (measured at a temperature of 35° C. using o-chlorophenol as a solvent, hereinafter the same) of 0.70 dL/g or more, and that the polyester of the sheath component has an intrinsic viscosity of 0.55 to 0.60 dL/g (constituent feature A).

In general, a polyester monofilament for a screen gauze is a high-strength monofilament suitable for precision printing, and the higher breaking strength can inhibit deterioration in weaving properties and the occurrence of gauze elongation and the like to obtain high dimensional stability. Here, the term "gauze elongation" as used herein means an elongation of monofilament constituting a gauze by receiving severer printing power repeatedly. Accordingly, stress generated in a low-elongation region is discussed as an alternative characteristic in many cases, and generally, the performance is evaluated by the stress at an elongation of 5% (modulus, hereinafter 5% LASE). In the polyester monofilament for a screen gauze of the present invention, the polymer having a high IV of 0.7 dL/g or more is used as the core component, thereby making it possible to obtain high strength, and the high-strength filament having a breaking strength of 6.0 cN/dtex or more is obtained. On the other hand, the intrinsic viscosity of the sheath component is from 0.55 to 0.60 dL/g. A monofilament having high-modulus properties according to the present invention and a fineness of 5 to 15 dtex usually has a risk of the occurrence of filament scraping. In contrast, according to the present invention, the intrinsic viscosity of the sheath component is adjusted to 0.55 to 0.60 dL/g, thereby being able to inhibit the occurrence of filament scraping, and preventing a decrease in modulus at an intermediate elongation. When the intrinsic viscosity of the sheath component exceeds 0.60 dL/g, the difference in intrinsic viscosity from the core component (the difference in physical properties=the difference in molecular orientation) becomes small, resulting in failure to substantially obtain the effect as a sheath-core type composite filament. On the other hand, when the intrinsic viscosity is less than 0.55 dL/g, the viscosity of a melt at the time of spinning is too low, which not only makes extrusion of the melt unstable, but also decreasing sheath-core stability and increasing a risk of melt leakage from a junction of a pack, resulting in inferiority from the viewpoint of establishing industrially stable productivity.

Then, in the polyester monofilament of the present invention, the weight ratio of the core component is from 50 to 70% (constituent feature B).

That is to say, the weight ratio of the high-IV core component is required to be from 50 to 70%, and it is preferably from55to70%. When it is less than 50%byweight, the influence of the sheath component on physical properties of the filament becomes significant, resulting in difficulty of achieving high strength and high modulus. On the other hand, when it exceeds 70% by weight, the thickness of the sheath component becomes 15% or less based on the diameter of the filament, and becomes extremely thin. Accordingly, the thickness varies by fluctuations such as fluctuations in viscosity in the course of transferring the melt, and in the extreme case, there is the danger of exposure of the core portion from the filament surface. Such fluctuations in the course of transferring the melt are liable to mainly occur in a bend portion of melt-transferring piping or in the vicinity of a melt-staying portion in the inside of a spinning pack, which also causes the formation of slubs that are a serious filament defect.

Examples showing the degree of thermal degradation of a polyester having an intrinsic viscosity of 0.80 dL/g under a nitrogen atmosphere (deoxidized state), that is to say, the degree of a decrease in intrinsic viscosity, are shown in Table 1.

TABLE 1

| | Temperature | | |
|---|---|---|---|
| Time | 280° C. | 290° C. | 300° C. |
| 5 min | 0.016 | 0.031 | 0.049 |
| 10 min | 0.031 | 0.050 | 0.087 |
| 15 min | 0.046 | 0.062 | 0.112 |

As seen from Table 1, the thermal deterioration of the polyester is extremely strongly influenced by temperature and the length of time exposed to heat. For the purpose of improving the quality level of the monofilament, it is vitally important to control changes in polymer viscosity caused by such a property. In the present invention, there is used a spinning pack as shown in FIG. 1, in which bends of piping are decreased, particularly the time from introduction into the pack to extrusion is restricted to 1 minute or less, and polymer flow paths are linearly formed from an inlet of the pack to an extrusion orifice of a spinneret with the interposition of a filter layer, with respect to the transfer of the core component polymer melt, thereby being able to reduce a risk of the occurrence of slubs due to fluctuations in the flow of the melt.

Then, in the polyester monofilament of the present invention, it is necessary that fine metal particles are contained in polyethylene terephthalate constituting at least the sheath component in an amount of 0.2 to 0.4% by weight (constituent feature C).

The term "fine metal particles" as used herein specifically means particles of titanium oxide, silica sol, silica, alkyl-coated silica, alumina sol, calcium carbonate and the like. However, they may be any as long as they are chemically stable when added to the polyester. From the viewpoints of chemical stability, aggregation resistance, ease of use and the like, titanium oxide, silica sol, silica and alkyl-coated silica are preferred, and titanium oxide is more preferred. When the titanium oxide is used, the average particle size of titanium oxide is preferably 0.5 μm or less, and more preferably 0.3 μm or less, in terms of dispersibility.

When the amount of the above-mentioned fine metal particles added to the sheath component exceeds 0.4% by weight, mechanical characteristics of the monofilament are decreased, and the particles are aggregated in the course of transferring the melt to deposit on the filament surface. This becomes the factor of scratching a reed at the time of weaving to result in deterioration of weaving properties with time. However, for the effect of inhibiting halation as a screen gauze, it is necessary to contain at least 0.2% by weight of the fine metal particles.

Further, the dope-dyed polyester monofilament of the present invention is required to contain the fine metal particles in polyethylene terephthalate constituting at least the sheath component in an amount of 0.2 to 0.4% by weight, to contain an organic pigment therein in an amount of 0.2 to 1.0% by weight, and to have a b value of 60 or more and an L value of 70 to 80 (constituent feature C').

Here, the kind and blended amount of fine metal particles are the same as with the above-mentioned constituent feature C, so that the description thereof is omitted.

Furthermore, when the glossiness of the screen gauze is adjusted only by the fine metal particles, the effect of inhibiting halation is insufficient, and the screen gauze is usually dyed yellow, red or black, to use. Ordinarily, light having a peak at a wavelength of 300 to 400 is used for exposure of the screen gauze to light. Accordingly, the screen gauze is dyed yellow in many cases. However, ultrafine filament yarns as fine as 5 to 15 dtex such as the monofilament of the present invention have the problem of difficulty to be deeply dyed. Further, they have the problem that the modulus of yarns is generally decreases by going through dyeing, according to a processing history such as its thermal history, to decrease the performance of the screen gauze. In the dope-dyed polyester monofilament of the present invention, in addition to the above-mentioned fine metal particles, the organic pigment is added to the sheath component polymer in an amount of 0.2 to 1.0% by weight, thereby adjusting the b value of the monofilament to 60 or more and the L value thereof to 70 to 80. This makes it possible to omit a dyeing process, and it becomes possible to reflect the high-modulus properties of the raw filament in woven fabric performance as such. When the amount of the organic pigment added is less than 0.2% by weight, it becomes impossible to deeply dye the monofilament. On the other hand, exceeding 1.0% by weight results in a decrease in modulus and the like.

As a method for adding the organic pigment to the sheath component polymer in the dope-dyed polyester monofilament, there is preferably used, for example, a method of preparing a master batch having a pigment concentration of about 10% by weight, and adding the master batch to the sheath component polymer, just ahead of an extruder, while observing the color tone. A method according to such mass coloration has hither to been known, but has the disadvantage that when such an organic pigment is added to a polymer having a high intrinsic viscosity, deterioration by hydrolysis is accelerated under the influence of moisture regain introduced from the outside to deteriorate physical properties of the filament. In the present invention, the organic pigment is added to only the sheath component polymer, of the respective sheath and core component polymers, thereby considering so that the core component polymer having a great influence on the physical properties is not affected. Thus, it has becomes possible to maintain the high halation-inhibiting effect while keeping the high performance.

Then, the polyester monofilament of the present invention is required to satisfy that the modulus at an elongation of 5% is from 3 to 4.5 cN/dtex, and that the breaking elongation is from 20 to 40%, when the monofilament has a fineness of 5 to 15 dtex (constituent feature D).

In the monofilament of the present invention having a fineness of 5 to 15 dtex, when the modulus at an elongation of 5% is less than 3 cN/dtex, or when the breaking elongation exceeds 40%, it is not said to have sufficient dimensional stability as a screen gauze. On the other hand, when the breaking elongation is less than 20%, it is difficult to absorb an impact applied to a woven fabric, resulting in easy occurrence of filament breakage at the time of weaving and filament breakage caused by fabric fatigue at the time of repeated use. Further, this is also liable to contribute to filament breakage in a drawing process. Furthermore, in the monofilament having a 5% LASE exceeding 4.5 cN/dtex, the orientation of the sheath component excessively increases to cause the occurrence of filament scraping, resulting in an insufficient fabric quality level.

In order to adjust the modulus at an elongation of 5% and the breaking elongation within the above-mentioned ranges in the polyester monofilament of the present invention, the intrinsic viscosity of the polyesters constituting the core component and sheath component, the weight ratio of the core component and sheath component, or spinning and drawing conditions are appropriately adjusted.

Then, in the polyester monofilament of the present invention, the degree of free shrinkage of the monofilament in a most inner layer portion of a taken-up package measured 10 days after winding up is 0.3% or less (constituent feature E).

The term "a most inner layer portion of a taken-up package" as used herein means a portion within 500 m after the initiation of winding up, of the polyester monofilament taken up on a bobbin or the like.

In a monofilament having high-modulus properties such as the monofilament of the present invention, pirn contraction is liable to occur by the influence of fiber structure strain existing in the inside of the monofilament. In order to remove this, it is necessary to wind up the monofilament with the strain in the product sufficiently relaxed. As an index therefor, the degree of free shrinkage in the most inner layer portion of the product is required to be 0.3% or less, and preferably 0.25% or less. In the present invention, the above-mentioned degree of free shrinkage can be attained to inhibit the pirn contraction by setting such conditions that a relaxation treatment of 0.3 to 0.5% is performed after drawing, followed by taking a relaxation time of 0.05 seconds from a final roller to winding up. According to the relaxation treatment within the range of 0.3 to 0.5%, it is possible to relax only the structure strain in the inside of the monofilament without impairing 5% LASE.

Then, in the polyester monofilament of the present invention, it is necessary that the number of slub portions per 100,000 meters in a filament longitudinal direction, which are 10 μm or more thicker than a filament diameter, is 1 or less, and preferably 0 (constituent feature F).

As the causes of the occurrence of the slub portions, there are a case in which a gelled polymer generated by thermal deterioration gradation in polymer piping and a pack is extruded in a spinning process and a case in which the slub portions occur due to delicate unevenness in viscosity of the sheath and core component polyesters. In order to restrict the number of the slub portions to 1 or less per 100,000 meters in a filament longitudinal direction, there is used a spinning pack as shown in FIG. 1, in which bends of piping are decreased, particularly the time from introduction into the pack to extrusion is restricted to 1 minute or less, and polymer flow paths are linearly formed from an inlet of the pack to an extrusion orifice of a spinneret with the interposition of a filter layer, with respect to the transfer of the core component polymer melt, thereby being able to reduce a risk of the occurrence of slubs due to fluctuations in the flow of the melt, as described above.

A melt spinning method of the polyester monofilament of the present invention and a spinning pack therefor will be illustrated in detail below with reference to the drawings.

FIG. 1 is a sectional front view schematically showing one embodiment of a sheath-core type multi-component spinning pack (hereinafter simply referred to as a "spinning pack") for melt spinning the polyester monofilament of the present invention. In FIG. 1, the reference numeral 1 is a pack body, which is divided into three parts, an upper pack body 11, an intermediate pack body 12 and a lower pack body 13, as shown in FIG. 1. Further, the reference numeral 2 (2*a*, 2*b*) designates a filter medium, the reference numeral 3 (3*a*, 3*b*) designates a polymer distributing member, the reference numeral 4 (4*a*, 4*b*) designates a polymer introduction member, the reference numeral 5 designates a sheath-core type multi-component spinning spinneret (hereinafter simply referred to as a "spinneret"), the reference numeral 6 designates a group of fastening bolts, and the reference numeral 7 designates a spinning orifice.

In FIG. 1, an alphabetical lowercase letter "a" is attached to members and flow paths through which core component polymer (A) flows, and an alphabetical lowercase letter "b" is attached to members and flow paths through which core component polymer (B) flows, for differentiation. Further, in FIG. 1, a core component polymer flow path H2*a* and a sheath component polymer flow path H2*b* are shown as they cross each other in the intermediate pack body 12. However, this is an expression for the sake of convenience for making the explanation clearly understandable, and it goes without saying that actually, the core component polymer flow path H2*a* and the sheath component polymer flow path H2*b* do not cross each other and form independent individual flow paths.

In the embodiment of the spinning pack of the present invention constructed as described above, the core component polymer flows from just after introduction into the pack into the spinning orifice 7 bored through the spinneret 5, through linear flow paths H1*a* and H2*a* excluding a portion in which the filter medium 2*a* is installed, via the shortest flow path. The linear flow paths H1*a* and H2*a* and the spinning orifice 7 are arranged so as to vertically form a straight line excluding the portion in which the filter medium 2*a* is installed, toward the down stream side to which core component polymer (A) flows down, as indicated by the dashed line in FIG. 1.

It is therefore understandable that core component polymer (A) stays in the spinning pack only for an extremely short period of time. Accordingly, it is not exposed to high temperature for a long period of time. Moreover, the flow path is linear, not curved, core component polymer (A) flows in the shortest distance for the shortest time from introduction into the spinning pack to extrusion from the spinning orifice 7 bored through the spinneret 5, and furthermore, there is no abnormal retention place in which the difference in retention time partially occurs.

In the present invention, the retention time of core component polymer (A) in the spinning pack is required to be from 10 seconds to 3 minutes, and more preferably from 10 seconds to 2 minutes. In addition, it is unfavorable to excessively shorten (for example, less than 10 seconds) the retention time of core component polymer (A), because there is the problem of insufficient heating time of the polymer, as well as restrictions on design of the spinning pack such as design of the filter layer unit.

Adding thereto a few more words, it goes without saying that the retention time of core component polymer (A) depends on the total flow path length (that is to say, the overall length of the linear flow paths) and each flow path diameter corresponding thereto. However, this flow path diameter and the above-mentioned total flow path length (that is to say, the overall length of the linear flow paths) are matters to be appropriately determined by conditions on the spinning pack side such as attaching dimensions of the spinning pack to a spin block, and the retention time of the polymer.

Generally, a main cause of fluctuations in viscosity of a molten polymer is considered to be thermal deterioration due to staying in a bend portion existing in a flow path for transferring the molten polymer or a spinning pack over a long period of time, and it is believed that when such a thermally deteriorated polymer is extruded from a spinning orifice of a spinneret as a monofilament, it forms the cause of the occurrence of slubs to bring about a serious filament defect.

For example, when the intrinsic viscosity is taken as an index for indicating the degree of thermal degradation (thermal deterioration) of a polyester having an intrinsic viscosity of 0.80 dL/g in a nitrogen atmosphere (deoxidized state), this degree of a decrease in viscosity shows the behavior as shown in Table 1. The term "intrinsic viscosity" as used in the present invention means "a value calculated by bringing C near 0 in an equation of $\eta$=limit (ln $\eta r/C$) obtained from the viscosity ($\eta r$) of diluted solutions having respective concentrations, which are each prepared by dissolving a sample in o-chlorophenol at 35° C.".

As seen from Table 1, the thermal deterioration of the polyester is extremely strongly influenced by temperature and the length of time exposed to heat. For the purpose of improving the quality level of the monofilament, it is vitally important to properly control changes in polymer viscosity in the spinning pack. In the present invention, therefore, particularly with respect to the flow paths through which core component polymer (A) flows, bends are decreased as much as possible, and the linear flow paths H1*a* and H2*a* are arranged with the interposition of the portion in which the filter medium 2*a* is installed.

Further, by thus arranging the linear flow paths H1*a* and H2*a*, it becomes possible to shorten the retention time of core component polymer (A) in the spinning pack to the utmost, and it is made possible to adjust within 2 minutes the retention time of core component polymer (A) from introduction into the spinning pack to extrusion from the spinneret 5. Then, this reduces a risk of the occurrence of slubs in molten core component polymer (A) due to fluctuations in the flow (the partial occurrence of the difference in retention time).

As described above, in the embodiment of the sheath-core type multi-component spinning pack of the present invention, the flow paths through which core component polymer (A) flows are linearly arranged with the interposition of the portion in which the filter medium 2*a* is installed, thereby shortening the retention time of the polymer in the spinning pack to the utmost and avoiding the formation of bend portions in the flow paths to the utmost. Accordingly, core component polymer (A) does not abnormally stay in the spinning pack, and can be controlled to flow for an extremely short period of time.

Then, the filter layer used in the present invention will be briefly explained. Usually, a filter layer (filter medium 2*a*) is provided in a spinning pack, in order to remove foreign matter contained in a polymer. This filter medium 2*a* is desirably provided on the most downstream side (usually just on the spinneret 5) of the spinning pack. It is because when the filter medium 2*a* is provided on the most downstream side in all paths until the polymer is extruded from the spinning orifice 7, foreign matter that comes to be mixed from any part or is generated in any part can be removed without fail.

Accordingly, it is desirable that the filter medium 2*a* is provided on the most downstream side (especially just on the spinneret) in the spinning pack. Consequently, also in the present invention, the filter medium 2*a* is provided in the spinning pack. This filter medium 2*a* is characterized by that when melt spinning is continued over the long term, the filter medium captures foreign matter in the polymer to inevitably increase filtration pressure. In that case, when this increase in filtration pressure is left as it is, polymer pressure in the spinning pack increases to generate unfavorable phenomena such as deterioration in a pressure resistant structure in the spinning pack and a decrease in sealing force for preventing polymer leakage, which causes polymer leakage, deformation of the spinneret, clogging of the spinning orifice bored through the spinneret, breakage of a gear pump, and the like.

Consequently, in order to prevent the internal pressure of the spinning pack from increasing beyond the allowable range, a disc-shaped filter medium (hereinafter also simply referred to as a "filter") attached to the filter medium 2*a*, which comprises a nonwoven fabric filter formed of thin metal wire or a wire mesh filter, must be periodically exchanged by frequently interrupting melt spinning and exchanging the spinning pack. At this time, in order to prolong the filter life to lengthen the exchange cycle of the filter, it is necessary to widen the filtration area of the filter, thereby avoiding an abrupt increase in filtration pressure due to the intensive capture of foreign matter in a narrow portion.

In general, in melt spinning of a polyester monofilament, the occurrence of a polymer gelled by thermal deterioration brings about filament breakage in a melt spinning process and filament breakage and wrapping around a body of rotation in a drawing process. This causes not only a decrease in spinability, but also the occurrence of slubs that are different from other portions in filament thickness by contamination of the monofilament with the thermally deteriorated polymer. This contributes to a reduction in the uniformity of the filament thickness relating to the uniformity of screen gauge openings in the monofilament, so that it is necessary to avoid the thermal deterioration of the polymer to the utmost.

Consequently, when the monofilament is melt spun, it becomes important to filter, remove or disperse the polymer thermally deteriorated by abnormal staying and gelled in a transfer pipe or the spinning pack by attaching the filter formed of the metal wire mesh or the nonwoven fabric to the filter medium 2 (2*a*, 2*b*). As a structure of this filter medium 2 (2*a*, 2*b*), a multilayer wire mesh filter 22 is preferred in which a seal member 21 is formed on an outer edge rim portion with aluminum alloy or the like. In particular, a multilayer filter is preferred in which at least one layer has a 25-mesh wire mesh layer, as shown as an example in FIG. 3. This is also for securing flow paths through which the polymer that has passed through a central portion of the filter medium 2 (2*a*, 2*b*) flows toward flow paths formed in a periphery portion of the distributing member 3 (3*a*, 3*b*). In FIG. 3, the flow direction of the polymer is indicated by the arrows.

However, in the spinning pack of the present invention, in addition to the filter medium 2 (2*a*, 2*b*), a filter sand portion 8 (8*a*, 8*b*) comprising metal sand or glass beads that are commonly used, for example, in a conventional spinning pack exemplified in FIG. 4 is not provided on the filter medium 2 (2*a*, 2*b*), as a constitution of the polymer filtration unit, because such a filter sand portion 8 (8*a*, 8*b*) particularly increases the retention time of core component polymer (A) in the spinning pack, and it becomes difficult to shorten it.

At this time, when filtration pressure acts on the filter medium 2 (2*a*, 2*b*), it is important to avoid deformation or breakage of the filter medium 2 (2*a*, 2*b*). Then, the disc-shaped polymer distributing member 3 (3*a*, 3*b*) having a function of joining again the polymer once spread for filtering the polymer at a wide filtration area, as well as a function of supporting the filter medium 2 (2*a*, 2*b*), is disposed just under the filter medium 2 (2*a*, 2*b*).

Then, the disc-shaped polymer distributing member 3 (3*a*, 3*b*) used in the present invention has a shape as schematically shown in FIG. 2. In FIG. 2, FIG. 2(*a*) shows a plan view of the distributing member 3 (3*a*, 3*b*), and FIG. 2(*b*) shows a sectional side view thereof. As apparent from FIG. 2, the disc-shaped polymer distributing member 3 (3*a*, 3*b*) is provided so as to be fitted in a concave portion of the intermediate pack body 12.

At this time, the distributing member 3 (3*a*, 3*b*) is fixed in the concave portion of the intermediate pack body 12 by fixing members 32 so as to form an annular flow path between an inner circumferential side face of the concave portion of the intermediate pack body 12 and an outer circumferential side portion of the distributing member 3 (3*a*, 3*b*). Accordingly, when all polymers (A) and (B) that have flowed in the filter medium 2 (2*a*, 2*b*) reach an upper face of a supporting portion 31 of the disc-shaped polymer distributing member 3 (3*a*, 3*b*), the direction of flow is changed from the vertical direction to the crosswise direction. In that case, all of polymers (A) and (B) that are changed in the direction of flow and spread to the crosswise direction flow toward the outer circumferential side, so that filtration is performed in the whole filtration area of the filter medium 2 (2*a*, 2*b*).

In that case, when grooves are radially formed on the upper face and/or a lower face or the supporting portion 31 of the disc-shaped polymer distributing member 3 (3*a*, 3*b*) from a center thereof toward its periphery, although not shown in FIG. 2, flows of polymers (A) and (B) filtered through the filter medium 2 (2*a*, 2*b*), toward the outer circumferential portion while laterally spreading, can be smoothly formed.

As described above, the above-mentioned polymer distributing member 3 (3*a*, 3*b*) is formed so that the whole polymer flows down in circular ring form through the annular flow path formed in the outer circumferential portion, and then, joins again at the center portion of the lower face thereof. With respect to this, if a orifice through which the polymer can flow down is opened at the center of the polymer distributing member 3 (3*a*, 3*b*), the difference in thermal history occurs between a polymer that has passed through this orifice and another polymer that has passed through the annular flow path of the outer circumferential portion. Accordingly, this unfavorably becomes a factor of conversely widening viscosity unevenness.

Then, sheath component polymer (B) will be described below. As sheath component polymer (B), a polymer having a low intrinsic viscosity is used. In general, when it is intended to obtain high breaking strength in polyester filament yarn, the occurrence of scams at the time of weaving is accelerated therewith. In the polyester filament yarn, the progress of orientation and crystallization increases the breaking strength of the filament yarn, but conversely, the filament yarn becomes brittle, and is weakened against bending, shearing and scraping. It is believed that the scams occur for this reason.

In the sheath-core type polyester monofilament of the present invention, it is necessary to form the core component polymer having a high breaking strength and a high modulus, and for this purpose, it is known that the intrinsic viscosity of the core component polymer is increased. In contrast, when the initial intrinsic viscosity of the sheath component polymer is set low, orientation and crystallization are inhibited, even when undrawn yarn is obtained in a melt spinning process and drawn at a high draw ratio in a drawing process. In that case, the breaking strength of the resulting filament yarn becomes low, and the filament yarn becomes strong against bending, shearing, scraping and the like.

In general, when a polyester polymer is once melted during a melt spinning process, it is difficult to maintain the high intrinsic viscosity before melting as it is, and a decrease in intrinsic viscosity is inevitable to some degree. Accordingly, the above-mentioned requirements that are essential in the present invention are required for core component polymer (A). However, as for sheath component polymer (B), when the intrinsic viscosity before melt spinning is high, the occurrence of scams at the time of weaving is all the more accelerated.

Accordingly, the low intrinsic viscosity is enough for sheath component polymer (B), so that a decrease in intrinsic viscosity that occurs by staying in the spinning pack for a long period of time is allowable to some degree. Further, the degree of a decrease in intrinsic viscosity of a polymer having a lower intrinsic viscosity in the spinning pack is relatively low, compared to that of a polymer having a higher intrinsic viscosity, and the influence of a decrease in intrinsic viscosity is smaller.

Thus, there is provided the melt spinning method of the polyester monofilament of the present invention and the spinning pack therefor, which have requirements giving top priority to a decrease in intrinsic viscosity of core component polymer (A) (that is to say, the prevention of thermal deterioration). That is to say, the polyester monofilament of the present invention is a high-strength monofilament suitable for precision printing. Deterioration in weaving properties and the occurrence of gauze elongation and the like can be inhibited to be able to obtain high dimensional stability.

However, according to such an increase in performance, the filament surface is scraped with a reed at the time of weaving to deteriorate weaving properties. Consequently, in the present invention, the sheath-core composite type monofilament in which polymer (A) having a high intrinsic viscosity for taking charge of the expression of physical properties is disposed in a core portion and polymer (B) having a low intrinsic viscosity for improving weaving properties is disposed in a sheath portion as a protective layer is spun, thereby solving these problems, and the spinning pack to which the maximum attention is given so that core component polymer (A) does not deteriorate in the spinning pack is used, thereby achieving the requirements required for a high-density screen gauze.

In sheath component polymer (B), changes in characteristics due to thermal history are small as described above, so that there is not so much necessity for homogenization to the intrinsic viscosity as in core component polymer (A) However, the more homogeneous the intrinsic viscosity is, the more difficult quality level abnormality such as slubs or filament scraping becomes to occur and better the production process is as for monofilament characteristics.

Then, it is effective to install a static kneading element for statically mixing the polymer without using motive power, in the flow path down stream from the filter medium 2*b*, thereby homogenizing the viscosity of sheath component polymer (B) so that unevenness of intrinsic viscosity does not occur, but it is extremely difficult to completely perform cleaning and to visually observe the state of cleaning. However, sheath component polymer (B) is allowed to stay in the spinning pack for a certain degree of time, so that it is a preferred embodiment in the present invention to insert, for example, a well-known static kneading element such as a Kenix type or Sulzer type one into the polymer flow path H2*b* having a long flow path length, as shown in FIG. 1.

Moreover, when the static kneading element is inserted into this polymer flow path H2*b*, the spinning pack is dismounted from the spin block and disassembled, after the termination of spinning, the static kneading element is taken out, and then, the polymer flow path H2*b* can be cleaned up in a naked state. Accordingly, even when the spinning pack is repeatedly used, a risk of incomplete cleaning can be infinitely decreased.

Then, as apparent from the embodiment of FIG. 1, in the spinning pack for a composite polyester monofilament of the present invention, the number of the spinning orifice 7 bored through the spinneret 5 is preferably one. It is because when a plurality of spinning orifice is bored through one spinneret and a plurality of monofilaments are intended to be spun, it becomes necessary to take boring positions of the spinning orifices into consideration so that the difference in physical properties between the respective monofilaments does not occur.

In contrast, when only one spinning orifice 7 is bored through the spinneret 5, only one monofilament is spun through one spinneret 5. Accordingly, no difference in physical properties substantially occurs. For this reason, in the spinning pack of the present invention, it has become possible to design the spinning pack that attaches very importance to the retention time of the core component polymer. Accordingly, the spinneret used in the present invention is characterized by that the position of the spinning orifice 7 bored through the spinneret 5 can be freely set without being bound by conventional common sense. As for the boring position of the spinning orifice 7, therefore, it can be provided in a position deviated from a center of the spinneret, not in the center of the spinneret such as the conventional spinneret.

The present invention relates to the sheath-core type composite monofilament in which the core component is arranged so as to be covered with the sheath component in its cross section and to be not exposed from a surface of the monofilament. What is necessary is just that the core component is completely covered with the sheath component, and they are not necessarily required to be concentrically arranged. However, it is preferred that they are concentrically arranged. As for the cross-sectional shape, there are several shapes such as circular, flat, triangular, square and pentangular shapes. However, the circular cross section is preferred in terms of stable filament production properties, easily obtainable higher-order processability, and stability of mesh openings for inhibiting the occurrence of halation when an emulsion is applied after weaving and exposed to light.

The polyester monofilament of the present invention is the high-strength monofilament suitable for precision printing, and the higher breaking strength can inhibit deterioration in weaving properties and the occurrence of gauze elongation and the like to obtain high dimensional stability. In the polyester monofilament of the present invention, the use of the polymer having a high intrinsic viscosity as the core component makes it possible to increase the strength, and the high-strength filament having a breaking strength of 6.5 cN/dtex or more is obtained. This can prevent orientation and the degree of crystallization at the surface of the sheath-core type composite polyester monofilament from increasing more than necessity, inhibit the amount of scams occurred at the time of weaving, and provide high dimensional stability.

Further, in the sheath-core type composite polyester monofilament of the present invention, both the core component and the sheath component are polyesters, so that a phenomenon of separation in a composite interface, which frequently occurs in polyester/nylon composite filament yarn, is difficult to occur. However, by adjusting the core component/sheath component weight composite ratio to 50:50 to 70:30, it can be prevented that the core is partially exposed from the surface to decrease the effect of inhibiting scams due to the sheath component. A decrease in thickness of the sheath component increases the amount of the core component polymer having a higher intrinsic viscosity, so that it preferably becomes possible to obtain higher strength.

The sheath-core type composite polyester monofilament of the present invention can be produced by utilizing the following multi-component spinning techniques. The polymers that form the core component and the sheath component are independently melted, metered and filtered, then, joined and combined using the spinneret and extruded from the same extrusion orifice so as to form a sheath-core composite filament, which is heated with a heating cylinder installed under the spinneret, and then, cooled. In order to obtain high strength, a drawing process becomes necessary. There may be used any method such as a method of obtaining high-strength drawn yarn by once winding undrawn yarn, and then, drawing it, or a method of obtaining drawn yarn by directly drawing spun yarn without winding after spinning.

EXAMPLES

The present invention will be described in more detail below with reference to examples.

In the examples, evaluations of intrinsic viscosity, strength, elongation, the degree of free shrinkage, filament scraping, the color tone of a monofilament and the like were performed in accordance with the following definitions:

Intrinsic Viscosity:

A sample was dissolved in o-chlorophenol at 35° C. to prepare diluted solutions of respective concentrations (C), and the intrinsic viscosity was calculated by bringing C near 0 in the following equation obtained from the viscosity (ηr) of these solutions.

$$\eta = \text{limit}(\ln \eta r / C)$$

Each of the sheath and core components was sufficiently discharged before the attachment of the spinning pack to stabilize a discharge state, and each discharged polymer was collected for measurement. Further, the intrinsic viscosity of the core component was confirmed using a sample obtained by decreasing the weight of a taken-up product to 50% or less thereof with an alkali.

Strength and Elongation:

The strength and elongation of filament yarn were measured based on JIS-L1017 by using a Tensilon tester manufactured by Orientech Inc. at a sample length of 25 cm and a elongation speed of 30 cm/min. The strength and elongation are values at the time when the sample was broken.

Modulus (Stress) at 5% Elongation:

In the above-mentioned measurement of the strength and elongation, the stress at the time when the sample was elongated by 5% was measured.

Degree of Free Shrinkage:

Excess filament yarn was stripped from drawn filament yarn taken up for about 1 minute to remove it, and 5,000 mm of a filament yarn sample was collected from the most inner layer portion. The sample was attached to a wall in hank form in a slack state at room temperature and no load, and the length of the filament yarn was measured again after 10 days. The difference between the filament yarn length after 10 days and the initial filament yarn length was divided by the initial filament yarn length, and the percentage indication thereof was taken as the degree of free shrinkage.

Evaluation of Number of Slubs:

Using an LS-7010(M) sensor and an LS-7500 controller manufactured Keynece Corporation, the number of fluctuation points of 10 μm or more was measured at a filament yarn speed of 100 m/min. Measurement was made for 50,000 m of each of 10 products, and the total of the number of fluctuation points detected was converted to that per 100,000 m of filament yarn length.

Evaluation of Filament Scraping:

A mesh fabric was woven by a Sulzer type weaving machine at a rotation number of 250 rpm using 120 warps per cm of weaving width, and the woven fabric was visually observed on a black board as a background. At this time, the number of fabric defects that a mesh pattern, which usually looks black, looks whitened by in woven scams of filament scraping was counted to perform evaluation. When the number of defects due to filament scraping is less than 5 per 30 m of fabric length in terms of 1.5 m of width, it was judged as ○, 5 to less than 10 was as Δ, and 10 or more was as ×.

Evaluation of Color Tone of Monofilament:

A monofilament was wrapped around a white board of 85 mm×45 mm at a rate of 40 turns per cm at equal spaces over a width of 60 mm. This operation was repeated twice in the same wrapping position to obtain a double-lap color measuring sample of 60 mm×45 mm. For this sample, measurement was made with a calorimeter. At this time, SPECTROPHOMETER CM-3610d manufactured by Minolta was used as the calorimeter.

Volume (V) of Core Component Polymer Staying in Spinning Pack:

The volume of the core component polymer staying in the inside of the spinning pack was determined by calculating the volume of each flow path through which the core component polymer flows, from a design drawing of the spinning pack.

Example 1

Polyethylene terephthalate containing 0.35% by weight of titanium oxide and having an intrinsic viscosity of 0.85 dL/g as a core component and polyethylene terephthalate containing 0.35% by weight of titanium oxide and having an intrinsic viscosity of 0.63 dL/g as a sheath component were each independently melted under a temperature of 295° C., and metered so as to give a core-sheath composite ratio of 60/40 by weight. At this time, the intrinsic viscosity of the discharged core component polymer sampled after 2 hours from the initiation of discharge was 0.73 dL/g, and that of the discharged sheath component polymer was 0.57 dL/g. Using a pack and a spinneret as shown in FIG. 1, the polymers were joined together and combined, and extruded from the same extrusion orifice, at a spinning temperature of 295° C. Just under the spinneret, a 90-mm long heater was installed so as to adjust the atmosphere temperature to about 350° C. After the extruded filament passed through a 1,000-mm long cold air zone, it was coated with a spinning oil solution so as to give a takeup of 0.2% by weight in terms of solid content, and taken up at a spinning speed of 1,200 m/min to obtain an undrawn filament. After pre-heated with a hot roller heated, this undrawn filament was drawn at a draw ratio of 3.8 and allowed to relax 0.3% while heating it with a slit heater, followed by taking up to obtain a 10-dtex/1-fil drawn filament. The resulting filament had a strength of 6.0 cN/dtex, an elongation of 25%, a modulus at an elongation of 5% (5% LASE) of 3.9 cN/dtex and a degree of free shrinkage of 0.23%. Further, the number of slub of the filament was measured. As a result, it was 0. The number of defects due to the occurrence of filament scraping at the time when this filament was weaved by a Sulzer type weaving machine was 0 per 30 m of fabric length. The intrinsic viscosity measured after decreasing the weight of the resulting drawn filament yarn to 50% with an alkali was 0.72 dL/g.

Comparative Example 1

A drawn filament was obtained in the same manner as in Example 1 with the exception that spinning was performed using a pack having a large filtration tank and bends in a melt flow path as shown in FIG. 4, in which the polymer passing time by calculation was 5 minutes. However, slub frequently occurred. At this time, the intrinsic viscosity measured after decreasing the weight of the resulting drawn filament yarn to 50% with an alkali (that is to say, the intrinsic viscosity of the core component) was 0.69 dL/g.

Example 2

A drawn filament was obtained in the same manner as in Example 1 with the exception that the intrinsic viscosity of polyethylene terephthalate used as the core component was changed to 0.9 dL/g. The intrinsic viscosity of the core component collected at an inlet of the pack in the same manner as in Example 1 was 0.8 dL/g. The quality level was similar to Example 1 except the 5% LASE was somewhat improved, and there was no particular problem. Such an increase in intrinsic viscosity is liable to cause melting unevenness. In that case, there is a fear of the occurrence of slubs. When slubs occur, a countermeasure such as the installation of a dynamic kneading unit in melting equipment is necessary.

Example 3

A drawn filament was obtained in the same manner as in Example 1 with the exception that the intrinsic viscosity of polyethylene terephthalate used as the sheath component was changed to 0.6 dL/g. The intrinsic viscosity of the sheath component collected at an inlet of the pack in the same manner as in Example 1 was 0.55 dL/g. The difference in both the physical properties and the quality level was scarcely observed, compared to Example 1, and it was confirmed that changes in characteristics at this level were in the range of error.

Comparative Example 2

A drawn filament was obtained in the same manner as in Example 1 with the exception that the intrinsic viscosity of polyethylene terephthalate used as the sheath component was changed to 0.7 dL/g. The intrinsic viscosity of the sheath component collected at an inlet of the pack in the same manner as in Example 1 was 0.65 dL/g. An increase in intrinsic viscosity of the sheath component decreased the difference in viscosity from the core component, and the occurrence of filament scraping was observed, similarly to the case where the core component appeared on the filament surface.

Comparative Example 3

A drawn filament was obtained in the same manner as in Example 1 with the exception that the intrinsic viscosity of polyethylene terephthalate used as the core component was changed to 0.7 dL/g. The intrinsic viscosity of the core component collected at an inlet of the pack in the same manner as in Example 1 was 0.65 dL/g. Associated with a decrease in intrinsic viscosity, a significant decrease in physical properties was observed. The reason for this appears to be that a pressure balance at a join of the core component polymer and the sheath component polymer changed, associated with a significant decease in viscosity of the core component. Then, one slub was detected. A test of compensating a decrease in physical properties by increasing the draw ratio was performed. However, filament scraping was frequently occurred at the time of weaving, resulting in poor weaving properties.

Example 4

A drawn filament was obtained in the same manner as in Example 1 with the exception that the composite ratio of the core component in the filament was changed to 50% by weight. There was no large difference in physical properties, and no serious problem also arose with respect to fabric quality level. The results are similar to those of Example 1.

Example 5

A drawn filament was obtained in the same manner as in Example 1 with the exception that the composite ratio of the core component in the filament was changed to 70% by weight. There was no large difference in physical properties, and no serious problem also arose with respect to fabric quality level. The results are similar to those of Example 1.

Comparative Example 4

A drawn filament was obtained in the same manner as in Example 1 with the exception that the composite ratio of the core component in the filament was changed to 90% by weight. From a product obtained by drawing an undrawn filament that was spun after the lapse of 3 days from the attachment of the spinning puck, the occurrence of filament scraping was observed. The cause thereof was considered to be fluctuations in thickness of the sheath layer caused by fluctuations in viscosity of the melt.

Comparative Example 5

A drawn filament was obtained in the same manner as in Example 1 with the exception that the composite ratio of the core component in the filament was changed to 40% by weight. The time for which the core component polymer was in a molten state increased, and a decrease in intrinsic viscosity was observed similarly to Comparative Example 3. The physical properties significantly decreased in view of its synergy effect. Further, the occurrence of slubs was observed which was considered to be the influence of a decrease in stability of the core polymer and instability at the join portion.

The results of Examples 1 to 5 and Comparative Examples 1 to 5 in which the intrinsic viscosity and the core/sheath composite ratio were changed are summed up in Table 2.

TABLE 2

| | | Intrinsic Viscosity (Inlet of Pack) | | Core Component | Fine | | | Degree | | Slub |
|---|---|---|---|---|---|---|---|---|---|---|
| | Spinning Pack | Core Component | Sheath Component | Weight Ratio % | Metal Particles % | 5% LASE cN/dtex | Breaking Elongation % | of Free Shrinkage % | Filament Scraping | Judgment/ 10,000 m) |
| Example 1 | FIG. 1 | 0.73 | 0.57 | 60 | 0.35 | 3.9 | 25 | 0.23 | ○ | 0 |
| Example 2 | FIG. 1 | 0.80 | 0.57 | 60 | 0.35 | 4.1 | 20 | 0.20 | ○ | 0 |
| Example 3 | FIG. 1 | 0.73 | 0.55 | 60 | 0.35 | 3.9 | 26 | 0.27 | ○ | 0 |
| Example 4 | FIG. 1 | 0.71 | 0.58 | 50 | 0.35 | 3.7 | 32 | 0.29 | ○ | 0 |
| Example 5 | FIG. 1 | 0.75 | 0.56 | 70 | 0.35 | 4.0 | 21 | 0.21 | ○ | 0 |
| Comparative Example 1 | FIG. 4 | 0.69 | 0.55 | 60 | 0.35 | 3.6 | 36 | 0.31 | ○ | 4 |
| Comparative Example 2 | FIG. 1 | 0.73 | 0.65 | 60 | 0.35 | 4.0 | 19 | 0.18 | Δ | 0 |
| Comparative Example 3 | FIG. 1 | 0.65 | 0.57 | 60 | 0.35 | 3.1 | 43 | 0.37 | ○ | 1 |
| Comparative Example 4 | FIG. 1 | 0.77 | 0.53 | 90 | 0.35 | 4.4 | 16 | 0.28 | X | 0 |
| Comparative Example 5 | FIG. 1 | 0.69 | 0.60 | 40 | 0.35 | 3.3 | 31 | 0.36 | ○ | 3 |

Example 6

Polyethylene terephthalate containing 0.35% by weight of titanium oxide and having an intrinsic viscosity of 0.85 dL/g as a core component and polyethylene terephthalate containing 0.35% by weight of titanium oxide and having an intrinsic viscosity of 0.63 dL/g as a sheath component were each independently melted under a temperature of 295° C., and metered so as to give a core-sheath composite ratio of 60/40 by weight. At this time, a pellet-shaped master batch (anthraquinone-based organic pigment concentration: 10% by weight) was added through an inlet of the extruder by using a loss-in-weight type weighing feeder so as to give a compounding ratio of 3% by weight. A base polymer before the addition of the pigment in the master batch was the same as the base polymer of the sheath component. The intrinsic viscosity of the discharged core component polymer sampled after 2 hours from the initiation of discharge was 0.73 dL/g, and that of the discharged sheath component polymer was 0.57 dL/g. Using a pack and a spinneret as shown in FIG. 1, the polymers were joined together and combined, and extruded from the same extrusion orifice, at a spinning temperature of 295° C. Just under the spinneret, a 90-mm long heater was installed so as to adjust the atmosphere temperature to about 350° C. After the extruded filament passed through a 1,000-mm long cold air zone, it was coated with a spinning oil solution so as to give a takeup of0.2% by weight in terms of solid content, and taken up at a spinning speed of 1,200 m/min to obtain an undrawn filament. After pre-heated with a hot roller heated, this undrawn filament was drawn at a draw ratio of 3.8 and allowed to relax 0.3% while heating it with a slit heater, followed by taking up to obtain a 10-dtex/1-fil drawn filament colored yellow. The resulting filament had a strength of 6.0 cN/dtex, an elongation of 25%, a modulus at an elongation of 5% (5% LASE) of 3.9 cN/dtex, a degree of free shrinkage of 0.23%, an L value of 79.6 and a b value of 65.0. Further, the number of slubs of the filament was measured. As a result, it was 0. The number of defects due to the occurrence of filament scraping at the time when this filament was weaved by a Sulzer type weaving machine was 0 per 30 m of fabric length. The intrinsic viscosity measured after decreasing the weight of the resulting drawn filament yarn to 50% with an alkali was 0.72 dL/g.

Comparative Example 6

A drawn filament was obtained in the same manner as in Example 1 with the exception that spinning was performed using a pack having a large filtration tank and bends in a melt flow path as shown in FIG. 4, in which the polymer passing time by calculation was 5 minutes. However, slubs frequently occurred. At this time, the intrinsic viscosity measured after decreasing the weight of the resulting drawn filament yarn to 50% with an alkali (that is to say, the intrinsic viscosity of the core component) was 0.69 dL/g.

Example 7

A drawn filament was obtained in the same manner as in Example 6 with the exception that the intrinsic viscosity of polyethylene terephthalate used as the core component was changed to 0.9 dL/g. The intrinsic viscosity of the core component collected at an inlet of the pack in the same manner as in Example 6 was 0.8 dL/g. The quality level was similar to Example 6 except the 5% LASE was somewhat improved, and there was no particular problem. Such an increase in intrinsic viscosity is liable to cause melting unevenness. In that case, there is a fear of the occurrence of slubs. When slubs occur, a countermeasure such as the installation of a dynamic kneading unit in melting equipment is necessary.

Example 8

A drawn filament was obtained in the same manner as in Example 6 with the exception that the intrinsic viscosity of polyethylene terephthalate used as the sheath component was changed to 0.6 dL/g. The intrinsic viscosity of the sheath component collected at an inlet of the pack in the same manner as in Example 6 was 0.55 dL/g. The difference in both the physical properties and the quality level was scarcely observed, compared to Example 6, and it was confirmed that changes in characteristics at this level were in the range of error.

Comparative Example 7

A drawn filament was obtained in the same manner as in Example 6 with the exception that the intrinsic viscosity of polyethylene terephthalate used as the sheath component was changed to 0.7 dL/g. The intrinsic viscosity of the sheath component collected at an inlet of the pack in the same manner as in Example 6 was 0.65 dL/g. An increase in intrinsic viscosity of the sheath component decreased the difference in viscosity from the core component, and the occurrence of filament scraping was observed, similarly to the case where the core component appeared on the filament surface.

Comparative Example 8

A drawn filament was obtained in the same manner as in Example 6 with the exception that the intrinsic viscosity of polyethylene terephthalate used as the core component was changed to 0.7 dL/g. The intrinsic viscosity of the core component collected at an inlet of the pack in the same manner as in Example 6 was 0.65 dL/g. Associated with a decrease in intrinsic viscosity, a significant decrease in physical properties was observed. The reason for this appears to be that a pressure balance at a join of the core component polymer and the sheath component polymer changed, associated with a significant decease in viscosity of the core component. Then, one slub was detected. A test of compensating a decrease in physical properties by increasing the draw ratio was performed. However, filament scraping was frequently occurred at the time of weaving, resulting in poor weaving properties.

Example 9

A drawn filament was obtained in the same manner as in Example 6 with the exception that the composite ratio of the core component in the filament was changed to 50% by weight. There was no large difference in physical properties, and no serious problem also arose with respect to fabric quality level. The results are similar to those of Example 6.

Example 10

A drawn filament was obtained in the same manner as in Example 6 with the exception that the composite ratio of the core component in the filament was changed to 70% by weight. There was no large difference in physical properties, and no serious problem also arose with respect to fabric quality level. The results are similar to those of Example 6.

Comparative Example 9

A drawn filament was obtained in the same manner as in Example 6 with the exception that the composite ratio of the core component in the filament was changed to 90% by weight. From a product obtained by drawing an undrawn filament that was spun after the lapse of 3 days from the attachment of the spinning puck, the occurrence of filament scraping was observed. The cause thereof was considered to be fluctuations in thickness of the sheath layer caused by fluctuations in viscosity of the melt.

Comparative Example 10

A drawn filament was obtained in the same manner as in Example 6 with the exception that the composite ratio of the core component in the filament was changed to 40% by weight. The time for which the core component polymer was in a molten state increased, and a decrease in intrinsic viscosity was observed similarly to Comparative Example 8. The physical properties significantly decreased in view of its synergy effect. Further, the occurrence of slubs was observed which was considered to be the influence of a decrease in stability of the core polymer and instability at the join portion.

The results of Examples 6 to 10 and Comparative Examples 6 to 10 in which the intrinsic viscosity and the core/sheath composite ratio were changed are summed up in Table 3.

TABLE 3

| | Spinning Pack | Intrinsic Viscosity (Inlet of Pack) Core Component | Intrinsic Viscosity (Inlet of Pack) Sheath Component | Core Component Weight Ratio % | Fine Metal Particles/ Pigment (*) | b Value/L Value (**) | 5% LASE cN/dtex | Breaking Elongation % | Degree of Free Shrinkage % | Filament Scraping | Slub Judgment/ 10,000 m) |
|---|---|---|---|---|---|---|---|---|---|---|---|
| Example 6 | FIG. 1 | 0.73 | 0.57 | 60 | 0.353 | 79.6<br>65.0 | 3.9 | 24 | 0.22 | ○ | 0 |
| Example 7 | FIG. 1 | 0.80 | 0.57 | 60 | 0.353 | 78.6<br>64.0 | 4.1 | 20 | 0.20 | ○ | 0 |
| Example 8 | FIG. 1 | 0.73 | 0.55 | 60 | 0.353 | 79.0<br>64.5 | 3.9 | 25 | 0.26 | ○ | 0 |
| Example 9 | FIG. 1 | 0.71 | 0.58 | 50 | 0.353 | 78.8<br>64.9 | 3.7 | 31 | 0.28 | ○ | 0 |
| Example 10 | FIG. 1 | 0.75 | 0.56 | 70 | 0.353 | 79.1<br>65.5 | 4.0 | 20 | 0.20 | ○ | 0 |
| Comparative Example 6 | FIG. 4 | 0.69 | 0.55 | 60 | 0.353 | 78.8<br>64.1 | 3.6 | 35 | 0.31 | ○ | 4 |
| Comparative Example 7 | FIG. 1 | 0.73 | 0.65 | 60 | 0.353 | 79.2<br>64.7 | 4.0 | 18 | 0.17 | Δ | 0 |
| Comparative Example 8 | FIG. 1 | 0.65 | 0.57 | 60 | 0.353 | 79.0<br>64.3 | 3.1 | 42 | 0.36 | ○ | 1 |
| Comparative Example 9 | FIG. 1 | 0.77 | 0.53 | 90 | 0.353 | 78.9<br>64.8 | 4.4 | 16 | 0.28 | X | 0 |
| Comparative Example 10 | FIG. 1 | 0.69 | 0.60 | 40 | 0.353 | 79.2<br>64.6 | 3.3 | 30 | 0.35 | ○ | 3 |

(*) The upper row shows the content of the fine metal particles (% by weight), and the lower row shows the content of the organic pigment (% by weight).
(**) The upper row shows the L value, and the lower row shows the b value.

Example 11

First, polyethylene terephthalate containing having an intrinsic viscosity of 0.85 dL/g as a core component and polyethylene terephthalate having an intrinsic viscosity of 0.63 dL/g as a sheath component were each independently melted under a temperature of 295° C., and metered so as to give a core-sheath composite ratio of 60/40 by weight, and continuously supplied to a spinning pack for melt spinning a sheath-core type composite monofilament, as shown in FIG. 1.

At this time, 4 spinning packs were prepared so that the retention time of the core component polymer was adjustable from 30 seconds to 2 minutes at 30-second interval, and this example was carried out using these packs. In this example, the polymers were not be taken up, but be discharged, and extruded from the another spinneret sampled after 2 hours from the initiation of discharge. The intrinsic viscosity of the core component polymer sampled was 0.73 dL/g, and that of the sheath component polymer was 0.57 dL/g. This retention time was converted from the amount of the core component polymer introduced into the spinning pack per unit of time by using a metering pump (gear pump), based on the volume (V) of the core component polymer staying in the spinning pack, which had been previously determined.

Then, using a spinning pack prepared so that the retention time of the core component polymer became 1 minute, a sheath-core composite monofilament was spun through a spinning orifice 7 at a spinning temperature of 295° C. Next, just under the spinneret 5, a heater having a length of 90 mm along a filament running direction was installed so as to adjust the atmosphere temperature to about 350° C., and the extruded filament was allowed to pass through the heating region and a 1,000-mm long cold air zone. Then, the spun monofilament was coated with a spinning oil solution so as to give an oil takeup of 0.2% by weight, and taken up at a spinning speed of 1,200 m/min to obtain an undrawn filament.

Then, after pre-heated with a hot roller, this undrawn filament was drawn at a draw ratio of 3.8 and allowed to relax 0.3% (relax treatment) while heating it with a slit heater in non-contact state, followed by taking up to obtain a 10-dtex drawn monofilament. The resulting filament had a strength of 6.0 cN/dtex, an elongation of 25% and amodulus at an elongation of 5% (5% LASE) of 3.9 cN/dtex. At the same time, the number of slubs of a sample collected from this drawn monofilament was measured. As a result, it was 2.

Then, the above-mentioned drawn monofilament was weaved by a Sulzer type weaving machine, and the number of defects due to the occurrence of filament scraping at that time was evaluated. As a result, it was substantially 0 per 30 m of fabric length, and no slub was detected. The intrinsic viscosity measured after decreasing the weight of the resulting drawn filament yarn to 50% with an alkali was 0.72 dL/g.

Example 12

A monofilament was produced in the same manner as in Example 11 with the exception that the retention time of the core component polymer in the spinning pack was changed to 2 minutes. The resulting drawn filament was evaluated. As a result, the number of slubs was 5. Further, the intrinsic viscosity measured after decreasing the weight of the resulting drawn filament yarn to 50% with an alkali was 0.71 dL/g.

Comparative Example 11

An experiment was made in the same manner as in Example 11 with the exception that spinning was performed using a conventional pack with a long retention time having a large filter layer and bends in a melt flow path as shown in FIG. 4, in which the polymer passing time by calculation was 5 minutes. The resulting drawn filament was evaluated. As a result, the number of slubs was as many as 25. Further, the intrinsic viscosity measured after decreasing the weight of the drawn filament yarn obtained at this time to 50% with an alkali was 0.69 dL/g. This revealed that polymer deterioration proceeded as a result of the long retention time of the polymer in the spinning pack.

INDUSTRIAL APPLICABILITY

The (dope-dyed) polyester monofilament of the present invention has excellent dimensional stability, the effect of inhibiting filament scraping, the effect of preventing pirn contraction and the effect of preventing halation, which have not been obtained for the conventional monofilaments, and has such fine fineness that the production of a high mesh is possible, high strength and high modulus, so that it is useful as a raw monofilament for ropes, nets, guts, tarpaulin, tents, screens, paragliders, sailcloth and the like. In addition, it is particularly suitable for obtaining mesh fabrics for screen printing, especially high-mesh high-modulus screen gauzes requiring high accuracy in the production of printed wiring boards and the like.

The invention claimed is:

1. A sheath-core type composite polyester monofilament in which 80 mol % or more of a structural unit is polyethylene terephthalate, wherein the following A to F are satisfied:

A. A polyester of a core component has an intrinsic viscosity of 0.70 dL/g or more, and a polyester of a sheath component has an intrinsic viscosity of 0.55 to 0.60 dL/g;

B. The weight ratio of the core component in the sheath-core type composite polyester monofilament is from 50% to 70%;

C. Fine metal particles are contained in polyethylene terephthalate constituting at least a sheath component in an amount of 0.2 to 0.4% by weight;

D. When the monofilament has a fineness of 5 to 15 dtex, the modulus at an elongation of 5% is from 3 to 4.5 cN/dtex, and the breaking elongation is from 20 to 40%;

E. The degree of free shrinkage of the monofilament in a most inner layer portion of a taken-up package measured 10 days after winding up is 0.3% or less; and F. The number of slub portions per 100,000 meters in a filament longitudinal direction, which are 10 μm or more thicker than a filament diameter, is 1 or less.

2. A melt spinning method of making the polyester monofilament according to claim 1 wherein a core component polyester polymer and a sheath component polyester polymer are introduced into a spinning pack from independent individual flow paths, respectively, and extruded from same spinning orifice, wherein the polyester monofilament is a sheath-core type composite polyester monofilament in which a core component polyester polymer and a sheath component polyester polymer comprise a polyester, wherein the retention time of the core component polymer from introduction into a spinning pack to extrusion from a spinneret is from 10 seconds to 3 minutes.

3. The melt spinning method according to claim 2, wherein said retention time of the core component polyester polymer is from 10 seconds to 1 minute.

4. The melt spinning method according to claim 2, wherein the sheath component polyester polymer introduced into the spinning pack is statically kneaded without using motive power after filtration through a filter medium.

5. The melt spinning method according to claim 2, wherein the weight composite ratio of (core component polyester polymer):(sheath component polyester polymer) is from 50:50 to 70:30.

6. The melt spinning method according to claim 2, wherein the sheath-core type composite polyester monofilament is melt spun through one spinning pack.

7. A dope-dyed sheath-core type composite polyester monofilament in which 80 mol % or more of a structural unit is polyethylene terephthalate, wherein the following A to F are satisfied:

A. A polyester of a core component has an intrinsic viscosity of 0.70 dL/g or more, and a polyester of a sheath component has an intrinsic viscosity of 0.55 to 0.60 dL/g;

B. The weight ratio of the core component in the sheath-core type composite polyester monofilament is from 50% to 70%;

C. Fine metal particles are contained in polyethylene terephthalate constituting at least a sheath component in an amount of 0.2 to 0.4% by weight, an organic pigment is contained therein in an amount of 0.2 to 1.0% by weight, the b value of the monofilament is 60 or more, and the L value is from 70 to 80;

D. When the monofilament has a fineness of 5 to 15 dtex, the modulus at an elongation of 5% is from 3 to 4.5 cN/dtex, and the breaking elongation is from 20 to 40%;

E. The degree of free shrinkage of the monofilament in a most inner layer portion of a taken-up package measured 10 days after winding up is 0.3% or less; and F. The number of slub portions per 100,000 meters in a filament longitudinal direction, which are 10 μm or more thicker than a filament diameter, is 1 or less.

8. A melt spinning method of making the dope-dyed polyester monofilament according to claim 7 wherein a core component polyester polymer and a sheath component polyester polymer are introduced into a spinning pack from independent individual flow paths, respectively, and extruded from same spinning orifice, wherein the polyester monofilament is a sheath-core type composite polyester monofilament in which a core component polyester polymer and a sheath component polyester polymer comprise a polyester, wherein the retention time of the core component polymer from introduction into a spinning pack to extrusion from a spinneret is from 10 seconds to 3 minutes.

9. The melt spinning method according to claim 8, wherein said retention time of the core component polyester polymer is from 10 seconds to 1 minute.

10. The melt spinning method according to claim 8, wherein the sheath component polyester polymer introduced into the spinning pack is statically kneaded without using motive power after filtration through a filter medium.

11. The melt spinning method according to claim 8, wherein the weight composite ratio of (core component polyester polymer):(sheath component polyester polymer) is from 50:50 to 70:30.

12. The melt spinning method according to claim 8, wherein the sheath-core type composite polyester monofilament is melt spun through one spinning pack.

* * * * *